US012631343B2

(12) United States Patent
Bräuning et al.

(10) Patent No.: US 12,631,343 B2
(45) Date of Patent: May 19, 2026

(54) COOKING APPLIANCE COMPRISING A HOT AIR SYSTEM AND A SPECIFICALLY SHAPED COOKING CHAMBER DIVIDER IN THE AREA OF A FRONT WALL OF THE HOT AIR SYSTEM

(71) Applicant: BSH Hausgeräte GmbH, Munich (DE)

(72) Inventors: Michael Bräuning, Altenmarkt (DE); Peter Jell, Breitbrunn (DE); Ragnar Somdalen, Vachendorf (DE); Jesus Vicente Tena Sanchez, Langerringen (DE); Wolfgang Hörner, Traunstein (DE)

(73) Assignee: BSH Hausgeräte GmbH, Munich (DE)

( * ) Notice: Subject to any disclaimer, the term of this patent is extended or adjusted under 35 U.S.C. 154(b) by 440 days.

(21) Appl. No.: 18/035,952

(22) PCT Filed: Nov. 17, 2021

(86) PCT No.: PCT/EP2021/081993

§ 371 (c)(1),
(2) Date: May 9, 2023

(87) PCT Pub. No.: WO2022/106470

PCT Pub. Date: May 27, 2022

(65) Prior Publication Data

US 2023/0408107 A1 Dec. 21, 2023

(30) Foreign Application Priority Data

Nov. 20, 2020 (DE) ..... 102020214630.6
Nov. 12, 2021 (DE) ..... 102021212764.9

(51) Int. Cl.
*F24C 15/16* (2006.01)
*F24C 7/04* (2021.01)
(Continued)

(52) U.S. Cl.
CPC ..... *F24C 15/16* (2013.01); *F24C 7/046* (2013.01); *F24C 7/062* (2013.01); *F24C 7/067* (2013.01);
(Continued)

(58) Field of Classification Search
CPC ..... F24C 15/166; F24C 7/067; F24C 7/06; F24C 15/16; F24C 15/322; F24C 15/325;
(Continued)

(56) References Cited

U.S. PATENT DOCUMENTS 4,771,163 A 9/1988 Thiboutot
7,087,863 B1 * 8/2006 Kim ..... F24C 15/325 219/394
(Continued)

FOREIGN PATENT DOCUMENTS

DE 4217545 A1 12/1993
DE 4224797 A1 2/1994
(Continued)

OTHER PUBLICATIONS

National Search Report DE 10 2021 212 764.9 dated Oct. 13, 2022.
National Search Report CN202180077878.3 dated Aug. 26, 2025.

*Primary Examiner* — Allen R. B. Schult
*Assistant Examiner* — Amy E Carter
(74) *Attorney, Agent, or Firm* — Michael E. Tschupp; Andre Pallapies; Brandon G. Braun

(57) ABSTRACT

A cooking appliance includes a muffle to define a cooking chamber in which a hot air system is arranged to form a receiving space the hot air system between a muffle rear wall and a front wall of the hot air system. Hot air flows from the receiving space into the cooking chamber through air passage openings in the front wall. A cooking chamber divider separates the cooking chamber into first and second cooking chamber regions in an end position in which the cooking
(Continued)

chamber divider overlaps with the front wall, when viewed in a depth direction of the cooking appliance and/or in a height direction of the cooking appliance. The cooking chamber divider has a front-wall-facing side with an edge region adjacent to the front wall and formed with an uneven flow conducting structure to deflect hot air through the air passage openings into the first cooking chamber region.

18 Claims, 3 Drawing Sheets

(51) Int. Cl.
*F24C 7/06* (2006.01)
*F24C 15/00* (2006.01)
*F24C 15/32* (2006.01)

(52) U.S. Cl.
CPC ..... *F24C 15/007* (2013.01); *F24C 15/322* (2013.01); *F24C 15/325* (2013.01)

(58) Field of Classification Search
CPC ..... F24C 15/18; F24C 7/046; F24C 7/062; F24C 15/007
USPC ..... 126/21 A, 337 R, 339; 219/394, 393, 219/392, 400
See application file for complete search history.

(56) References Cited

U.S. PATENT DOCUMENTS

| | | | | |
|---|---|---|---|---|
| 2006/0027559 | A1 | 2/2006 | Kim | |
| 2006/0137675 | A1* | 6/2006 | Kim | F24C 15/325 126/21 A |
| 2009/0032521 | A1 | 2/2009 | Kim | |
| 2011/0253123 | A1 | 10/2011 | Claussen | |
| 2012/0272832 | A1 | 11/2012 | Kwon | |
| 2014/0083992 | A1 | 3/2014 | Linnewiel | |
| 2014/0174426 | A1* | 6/2014 | Moon | F24C 3/087 126/21 A |
| 2020/0309379 | A1* | 10/2020 | Paller | F24C 15/322 |

FOREIGN PATENT DOCUMENTS

| | | | |
|---|---|---|---|
| DE | 10301131 | B3 | 5/2004 |
| DE | 102011079096 | A1 | 1/2013 |
| DE | 102013111480 | A1 | 5/2015 |

* cited by examiner

COOKING APPLIANCE COMPRISING A HOT AIR SYSTEM AND A SPECIFICALLY SHAPED COOKING CHAMBER DIVIDER IN THE AREA OF A FRONT WALL OF THE HOT AIR SYSTEM

CROSS-REFERENCES TO RELATED APPLICATIONS

This application is the U.S. National Stage of International Application No. PCT/EP2021/081993, filed Nov. 17, 2021, which designated the United States and has been published as International Publication No. WO 2022/106470 A1 and which claims the priorities of German Patent Applications, Serial Nos. 10 2020 214 630.6, filed Nov. 20, 2020 and 10 2021 212 764.9, filed Nov. 12, 2021, pursuant to 35 U.S.C. 119 (a)-(d).

The contents of International Application No. PCT/EP2021/081993 and German Patent Applications, Serial No. 10 2020 214 630.6 and 10 2021 212 764.9 are incorporated herein by reference in their entireties as if fully set forth herein.

BACKGROUND OF THE INVENTION

One aspect of the invention relates to a cooking appliance comprising a housing and comprising a muffle. The housing can also be denoted as an external housing. The muffle is a separate component from the housing. The muffle is arranged in the housing. Walls of the muffle define a cooking chamber of the cooking appliance. The cooking appliance also has a hot air system. The hot air system has a front wall. This front wall is arranged in the cooking chamber such that a receiving space for components of the hot air system is formed between a rear wall of the muffle and this front wall, which is offset in particular to the front relative to the rear wall, when viewed in the depth direction of the cooking appliance. The front wall has air passage openings through which hot air can be conducted from this receiving space into the cooking chamber. Moreover, the cooking appliance has a cooking chamber divider. This cooking chamber divider is a separate component. The cooking chamber divider is configured, in particular, in a plate-like manner. The cooking chamber divider can be removed from and reintroduced into the cooking chamber in a reversible manner. In the end position of the cooking chamber divider, when introduced into the cooking chamber, this cooking chamber is separated by this cooking chamber divider into a first cooking chamber region and into a second cooking chamber region.

Such cooking appliances are known from the prior art. Cooking chamber dividers can be arranged in the cooking chamber spaced relatively far apart from the front wall. However, the division into the cooking chamber regions is limited thereby, and the positioning of the hot air system relative to the cooking chamber divider requires a corresponding amount of space. As a result, on the one hand, potentially the front wall has to be designed to be smaller or, on the other hand, the cooking chamber divider has to be positioned spaced relatively far apart from the front wall.

In other types of cooking appliances, the cooking chamber divider can also be positioned relatively close to the front wall in its end position. However, with the planar upper faces of such a cooking chamber divider the drawback arises here that the air openings are potentially covered relatively extensively by the adjacent surface areas of the cooking chamber divider, such that the outlet of air from such air passage openings is impeded. In particular, an accumulation of air can occur at this interface as a result. This can also lead to air passing or being forced into that cooking chamber region in which it is undesirable for hot air to be introduced by the hot air system.

BRIEF SUMMARY OF THE INVENTION

It is the object of the present invention to provide a cooking appliance in which such an accumulation of air is prevented in an improved manner when the cooking chamber divider is positioned adjacent to a hot air system.

This object is achieved by a cooking appliance which has the features as claimed in claim 1.

One aspect of the invention relates to a cooking appliance comprising a housing and comprising a muffle. The housing can also be denoted as an external housing. The muffle is a separate component from the housing. The muffle is arranged in the housing. Walls of the muffle define a cooking chamber of the cooking appliance. The cooking appliance also has a hot air system. The hot air system has a front wall. This front wall is arranged in the cooking chamber such that a receiving space for components of the hot air system is formed between a rear wall of the muffle and this front wall, which is offset in particular to the front relative to the rear wall, when viewed in the depth direction of the cooking appliance. The front wall has air passage openings through which hot air which is generated by the hot air system can be conducted by the hot air system from this receiving space into the cooking chamber. Moreover, the cooking appliance has a cooking chamber divider. This cooking chamber divider is a separate component. The cooking chamber divider is configured, in particular, in a plate-like manner. The cooking chamber divider can be removed from and reintroduced into the cooking chamber in a reversible manner. In the end position of the cooking chamber divider, when introduced into the cooking chamber, this cooking chamber is divided by this cooking chamber divider into a first cooking chamber region and into a second cooking chamber region separate therefrom.

In particular, in its end position the cooking chamber divider is arranged so as to overlap with the front wall, when viewed in the depth direction of the cooking appliance. Additionally or alternatively, in its end position the cooking chamber divider is arranged so as to overlap with the front wall, when viewed in the height direction of the cooking appliance. On the side of the cooking chamber divider facing the front wall in an edge region of the cooking chamber divider adjacent to the front wall an uneven flow conducting structure is formed. This flow conducting structure is configured and provided as intended such that the hot air which enters the cooking chamber through air passage openings in the front wall and air flowing against the cooking chamber divider can be deflected into the cooking chamber region to be supplied with the hot air. With an immediately adjacent arrangement between the cooking chamber divider and the front wall, an improved flow behavior of the hot air escaping through the air passage opening is thus achieved by such an uneven flow conducting structure. This is because although the cooking chamber divider and the front wall are arranged immediately adjacent to one another at this interface, this uneven flow conducting structure makes it possible to deflect this hot air without any accumulation into the cooking chamber region which is to be supplied with the hot air. This is because a corresponding air space or volume space is provided in which an undesired accumulation of hot air is avoided in an improved manner. By means of this uneven flow conducting structure, in particular at this interface, an increase in the volume space is provided in comparison with the adjacent zones between the cooking chamber divider and the front wall, so that the entry of hot air from the air passage opening into this volume space is improved, or is associated with reduced air accumulation behavior, and the immediate and improved deviation of this hot air from this enlarged air space into the further cooking chamber is also permitted thereby. This is also implemented by the flow conducting structure which assists the outflow of this incoming hot air into the further cooking chamber in an improved manner. Thus it is also achieved that incoming hot air from the air passage opening does not accumulate at this interface between the cooking chamber divider and the front wall, and the situation where this accumulated air is then forced into the other cooking chamber region is also avoided thereby in an improved manner. In particular, the situation where air which accumulates here at this interface with the cooking chamber divider is forced past the edge region of the cooking chamber divider into the other cooking chamber region is avoided thereby in an improved manner.

In the hot air system operated here, this makes it possible in an improved manner to avoid the undesired entry of hot air into the other cooking chamber region in an improved manner so that in the other cooking chamber region, in particular when a food preparation process is carried out, the food preparation process therein is not impaired by the incoming hot air which would be undesired.

In one exemplary embodiment, the flow conducting structure has in the edge region at least in some regions an, in particular groove-like, depression. This depression is formed in the aforementioned facing side so that an enlarged air inflow space or an enlarged volume space is formed here between the front wall and the facing side. Thus by means of this depression, the sub-region of the facing side of the cooking chamber divider which is arranged directly opposing the front wall is formed spaced further apart from the front wall by means of this depression, whereby this enlarged air inflow space is formed. Such a specific geometric design of this facing side in the immediate interface region toward the front wall permits the aforementioned advantages to a particular extent. Moreover, on the one hand, this geometry of the flow conducting structure is very simple and particularly advantageously assists the flow behavior. On the other hand, this embodiment of the upper face or the facing side of the cooking chamber divider comprising the depression can also be produced in a simple manner in terms of manufacturing technology.

The depression has a defining wall. This defining wall is curved at least in some regions. The defining wall in cross section, when viewed perpendicularly to the longitudinal axis of the depression, in particular, is curved in a concave manner, in particular is curved in a concave manner over at least 70%, in particular at least 80%, of its length between the depression upper edges. Thus it is bulged facing away from the front wall. As a result, an enlarged volume space is particularly advantageously formed between the front wall and this defining wall of the depression. The incoming air into the volume space, in particular an increased air inflow space, then strikes this, in particular, continuously curved defining wall, whereby the air can be forwarded in a particularly uniform manner and without accumulation. In particular, when viewed in cross section the defining wall has no corners. When viewed in cross section, the defining wall of the depression does not have a wall portion which is parallel to the front wall. The front wall has in cross section, in particular, rectilinear wall portions.

In one exemplary embodiment, when viewed in the depth direction of the cooking appliance, this depression is configured so as to overlap with the front wall. This assists both the inflow of the hot air via the at least one air passage opening into the cooking chamber, in particular into the interface region between the front wall and the cooking chamber divider and, on the other hand, this relative positioning is also particularly advantageous in order to permit a very oriented and uniform diversion of the incoming hot air from this depression via the further flow conducting structure into the remaining cooking chamber.

In one exemplary embodiment, when viewed in the height direction of the cooking appliance, the depression is configured so as to overlap with the front wall. The aforementioned advantages are additionally made possible thereby. As a result, a longer defining wall is also formed by this depression in the height direction. As a result, the guided and particularly homogenous and uniform diversion of the hot air from this depression into the cooking chamber is further assisted. Undesirably high turbulence or an undesirably large air accumulation of the hot air in the depression itself can also be prevented thereby.

In one exemplary embodiment, the depression is formed so as to be shaped around a lower edge region of the front wall. In this lower edge region or in the lower corner region, therefore, this permits a flow behavior of the hot air which passes through an air passage opening and which at this lower edge region cannot accumulate any further or potentially form a corresponding constriction of the air inflow space. This is because at this lower edge region a spacing of the edge region from the wall of the depression can also be provided by means of this exemplary embodiment, which permits a very advantageous, in particular uniform, outflow into the further cooking chamber, which at least reduces an accumulation of air.

In one exemplary embodiment, when viewed in the depth direction of the cooking appliance, a rear depression upper edge of the depression is arranged offset to the front relative to a rear end of the cooking chamber divider. Thus, when viewed in the depth direction, the depression is not configured entirely up to the rear edge of the cooking chamber divider. This is a further advantageous exemplary embodiment because it is possible to avoid thereby the situation where the hot air, which passes through the front wall through the air passage openings, is able to pass extensively and easily as far as this rear end of the cooking chamber divider, and then potentially could in turn be forced extensively around this rear end and could flow into the other cooking chamber region. Since at this rear end the cooking chamber divider runs upwardly or is arranged immediately adjacent to the front wall, in particular potentially also bears at least in some regions against the outer face of the front wall, a flow stop can also be achieved here for the incoming hot air. Since this depression is thus configured to be offset to the front, the hot air can also be directly conducted into the depression in an improved manner and by the geometry and the design of the depression, and also regarding the spacing relative to the outer face of the front wall, the hot air can flow out in the desired direction into the further cooking chamber. The spacing of the depression, in particular the defining wall thereof relative to the front wall, is greater than the minimum spacing between the region of the cooking chamber divider relative to the front wall adjoining the depression to the rear.

In one exemplary embodiment, a front depression upper edge of the depression, when viewed in the depth direction of the cooking appliance, is arranged higher, when viewed in the depth direction of the cooking appliance, than a rear depression upper edge of the depression, when viewed in the depth direction of the cooking appliance. Thus these two depression upper edges which are configured offset to one another in the depth direction and which thus define the depression on the end side, when viewed in this depth direction, are configured to be offset to one another in the height direction. A geometry is also provided thereby which, on the one hand, assists the improved inflow of the hot air from the front wall into the depression and, on the other hand, permits a particularly advantageous guided discharge of the incoming hot air from the depression into the further cooking chamber. In particular, the situation where undesirably high turbulence is formed around a lower edge region of the front wall, which might potentially restrict the further outflow behavior of the hot air from the depression, is also avoided thereby.

In one exemplary embodiment, when viewed in the depth direction, a front depression region of the depression is formed as a flow ramp as far as a front depression upper edge of the depression. The flow ramp is oriented upwardly, in particular. The flow ramp is thus a rising, curved defining wall portion. This also means that this front depression region, in particular, is curved continuously, and preferably is curved in a continuously concave manner. Since the front depression region extends upwardly with its curvature in the height direction here, a particularly advantageous air guiding geometry is provided. This flow guiding geometry can also be formed as a flow ramp according to the above-mentioned example, whereby a particularly efficient guidance and also a discharge of the air from the depression into the remaining cooking chamber is achieved.

In particular, this flow ramp extends from a minimum point of the groove-shaped defining wall as far as the front depression upper edge. The flow ramp extends in the height direction, in particular from its rear end which is below the edge region of the front wall, as far as a front end which is located in the height direction, in particular above the edge region.

In one exemplary embodiment, the front wall is formed in a trough-shaped manner. This trough shape has a front plate and a front wall shroud. The front wall shroud is arranged over the periphery on an edge of the front plate. Such a front wall is inherently more stable and more rigid. Thus it also has greater deformation stability when subjected to larger amounts of heat. Moreover, in a particularly advantageous manner the receiving space can be defined by this front wall shroud on the narrow sides of the receiving space. In particular, it can be provided that in the mounted state of the front wall this front wall shroud bears against the rear wall at least in some regions. Thus the receiving space is also closed at least in some regions on its narrow peripheral side, which is formed by the spacing measured in the depth direction between the rear wall and the front wall. An undesired escape of hot air at these regions is avoided thereby. In particular, it is made possible thereby that the hot air which is generated in the correspondingly closed receiving space only enters or substantially only enters into the cooking chamber through the air outlet openings which are formed and arranged in a defined manner in the front wall.

In one exemplary embodiment, in the end position in the cooking chamber, when viewed in the depth direction of the cooking appliance, the cooking chamber divider is arranged so as to overlap by at least 50%, in particular by at least 80%, with the front wall shroud of the front wall. Thus not only is a linear edge provided here, as might be formed solely by the front plate on its edge, but in the depth direction a larger overlapping region with the cooking chamber divider is also implemented by these flat strips of the front wall shroud. In such exemplary embodiments, the invention is particularly advantageous. This is because a larger interface region is produced here between the facing side of the cooking chamber divider relative to the front wall and this front wall shroud. Specifically at that point, incoming hot air can potentially accumulate and be forced around the cooking chamber divider and flow into the other cooking chamber sub-region in a particularly disadvantageous manner. This is avoided particularly advantageously by the invention. This is because since an enlarged air inflow space, which is specified geometrically and positionally by the depression, between the front wall shroud and the side of the cooking chamber divider facing the front wall shroud, is also formed by the depression, an undesired accumulation of the incoming hot air is particularly advantageously avoided specifically at this interface region between the front wall shroud and the cooking chamber divider.

In one exemplary embodiment, when viewed in the depth direction, a rear depression upper edge of the depression is arranged at a first spacing, which in particular is vertical when viewed in the height direction, from the front wall shroud of the front wall. A front depression upper edge of the depression, when viewed in the depth direction, is arranged at a second spacing, which is horizontal when viewed in the depth direction, in particular, from the front plate of the front wall. In particular, the first spacing is smaller than the second spacing. Thus the air inflow space is increased or widened by this geometry at least in some regions from the rear to the front and upwardly. A particularly advantageous entry of the hot air into the depression and a particularly advantageous forwarding of this incoming hot air into the air inflow space toward the remaining cooking chamber is permitted thereby.

In one exemplary embodiment, at least one air passage opening is formed in the front wall shroud. The aforementioned invention is particularly advantageous specifically in such an exemplary embodiment. This is because hot air passes through this at least one air passage opening which is specifically locally arranged in the front wall shroud, in one exemplary embodiment it flows downwardly in the height direction directly against the cooking chamber divider. Since specifically in this exemplary embodiment, this depression is arranged in the cooking chamber divider in the region of the air passage opening which is arranged in the front wall shroud, the air inflow space is also provided specifically at this air passage opening. Thus specifically at this local position a particularly advantageous inflow of hot air, at least reducing a backlog, can take place toward the cooking chamber divider and by the embodiment thereof with the uneven flow conducting structure, in particular the depression, the hot air can be diverted into the further cooking chamber so as to be guided in a very appropriate manner.

In one exemplary embodiment, the depression and the air passage opening are arranged so as to overlap one another at least in some regions in the front wall shroud, when viewed in the depth direction. The resulting advantages have already been mentioned above.

In one exemplary embodiment, the at least one air passage opening in the front wall shroud is configured with an inclined wall which protrudes from the air passage opening to the rear into the receiving space. It is achieved thereby that hot air in the receiving space is guided by this inclined wall in a quite specific manner to the air passage opening. In particular, the hot air is guided by this inclined wall into the receiving space in a direction of flow which is oblique relative to the hole axis of the air passage opening. This is because the hot air flows obliquely into the depression when passing through the air passage opening facing the cooking chamber. In this exemplary embodiment, the direction of flow of this hot air is not perpendicular, or not fundamentally perpendicular, to the hole axis of the air passage opening but oblique thereto. This inclined wall thus promotes the throughflow behavior of the hot air through the air passage opening, so that the hot air passing therethrough already has a predefined direction of flow in the cooking chamber. This inclined wall is oriented obliquely into the depression and faces the cooking chamber. This direction of flow, in particular, faces away from a rear end of the cooking chamber divider. The situation where hot air, which flows through the air passage opening into the depression, could pass to the rear end of the cooking chamber divider from which the depression is slightly spaced apart, in particular, in the facing side of the cooking chamber divider, is also avoided thereby in an improved manner. This inclined wall can, for example, be a bent-back portion of a sub-region cut out from the front wall.

The front wall can be configured from metal. The front wall can, for example, be sheet metal, in particular sheet steel. On the one hand, the inclined wall, when considered per se, can be produced and arranged in a manner which is simple and positionally accurate and, on the other hand, also correspondingly stable relative to the effects of larger amounts of heat.

In one exemplary embodiment, the cooking chamber divider encompasses the entire width of the clear width of the cooking chamber between the two vertical side walls of the muffle. In particular, in one exemplary embodiment the cooking chamber divider encompasses the entire clear width of the depth as far as the front loading opening of the cooking chamber. The cooking chamber divider is preferably formed as an uninterrupted plate. In one exemplary embodiment, the cooking chamber divider can thus also be formed or denoted as a partition plate.

The positions and orientations provided when the appliance is used as intended and arranged as intended are specified by the terms "above", "below", "front", "rear", "horizontal", "vertical", "depth direction", "width direction", "height direction", etc.

Further features of the invention are found in the claims, the figures and the description of the figures. The features and combinations of features mentioned above in the description and the features and combinations of features mentioned hereinafter in the description of the figures and/or shown individually in the figures are not only able to be used in the respectively specified combination but also in other combinations or alone without departing from the scope of the invention. Thus embodiments of the invention which are not explicitly shown and explained in the figures but which emerge from and can be generated by separate combinations of features from the explained embodiments are to be regarded as encompassed and disclosed. Embodiments and combinations of features, which thus do not have all of the features of an originally formulated independent claim, are also to be regarded as disclosed.

BRIEF DESCRIPTION OF THE DRAWINGS

Exemplary embodiments of the invention are explained in more detail hereinafter with reference to schematic drawings. In the drawings.

DETAILED DESCRIPTION OF EXEMPLARY EMBODIMENTS OF THE PRESENT INVENTION

Figure 1:
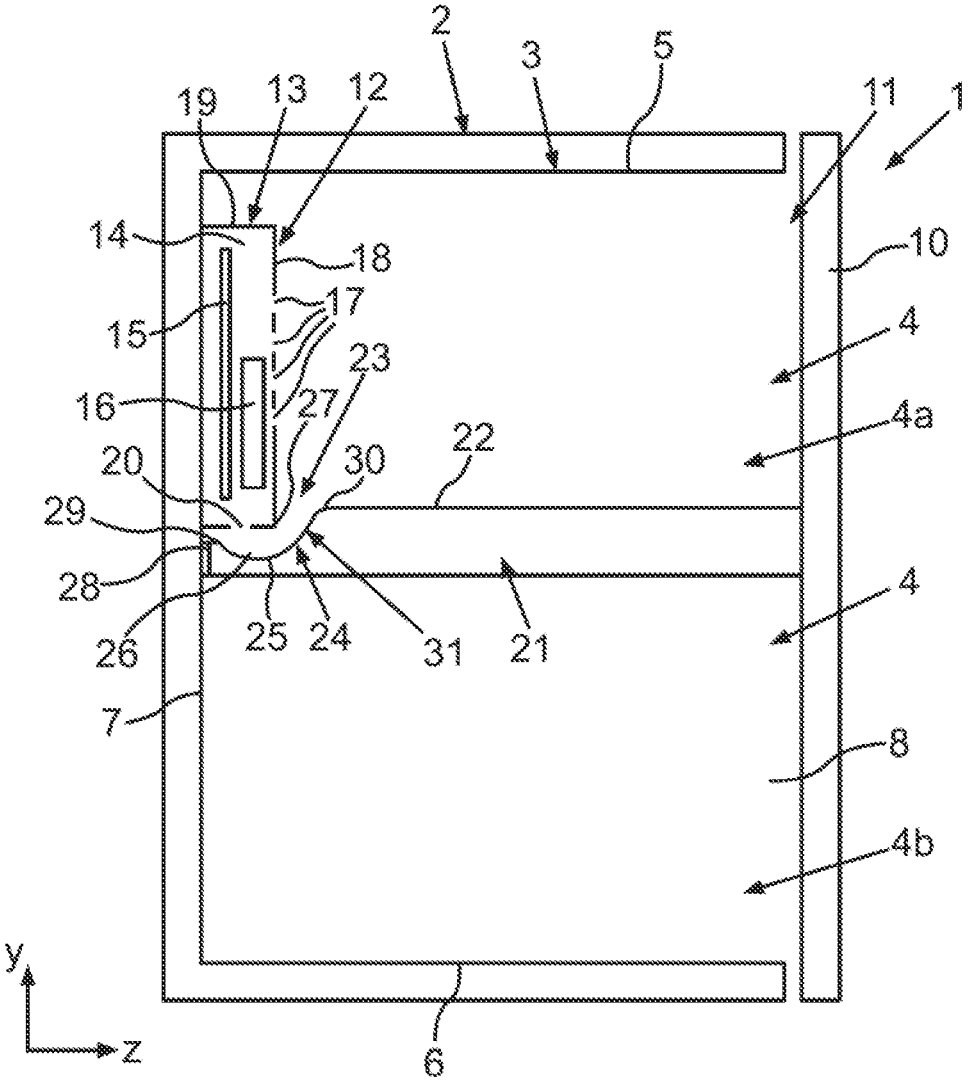
FIG. 1 shows a schematic vertical sectional view through an exemplary embodiment of a cooking appliance according to the invention.

Elements which are the same or functionally the same are provided with the same reference characters in the figures.

In FIG. 1 an exemplary embodiment of a cooking appliance 1 is shown in a schematic, vertical sectional view. The cooking appliance 1 can be an oven, for example. The cooking appliance can be a microware cooking appliance or a steam cooking appliance. A cooking appliance 1 which is an oven with a combined microwave function and/or steam cooking function can also be provided.

Figure 2:
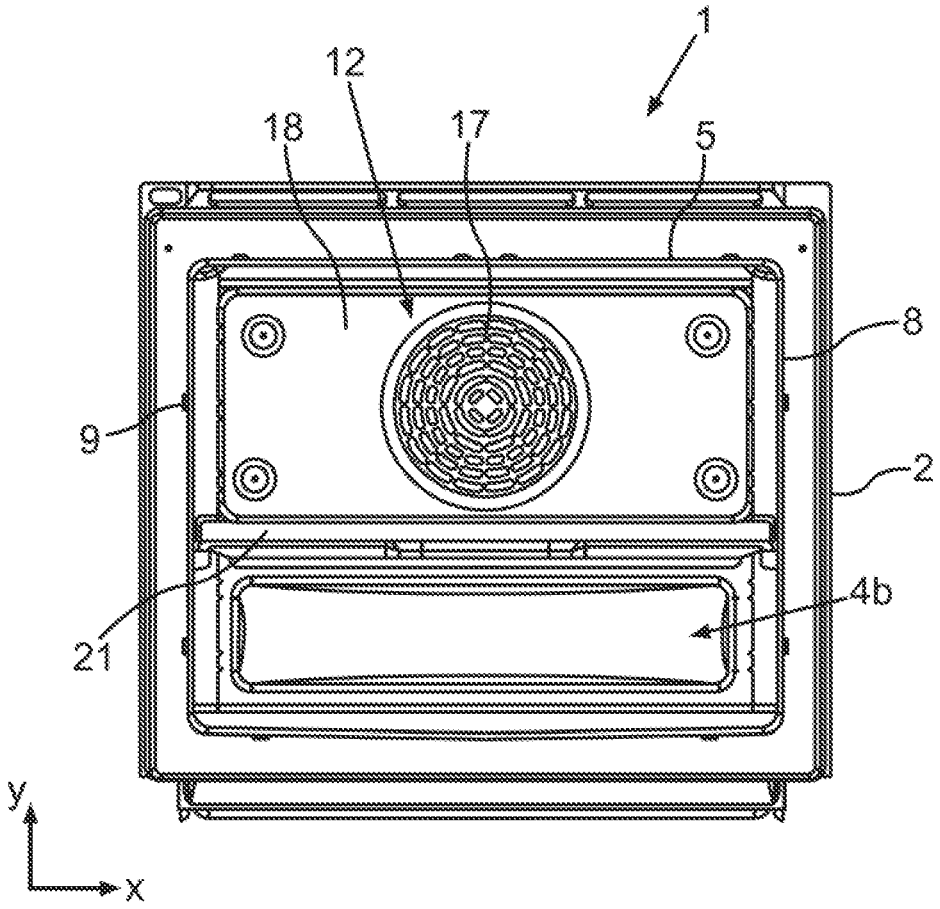
FIG. 2 shows a front view of an exemplary embodiment of a cooking appliance according to the invention.

The cooking appliance 1 has a housing 2. This housing can also be denoted as the external housing. The cooking appliance 1 also has a muffle 3. The muffle 3 is a component which is separate from the housing 2. The muffle 3 is received in the housing 2. The muffle 3 defines a cooking chamber 4 of the cooking appliance 1 by means of walls. In the exemplary embodiment shown here, the muffle 3 has a top wall 5, a bottom wall 6, a rear wall 7 and opposing side walls 8 and 9 (FIG. 2). The cooking chamber 4 is defined by these walls 5 to 9. Thermally insulating material can be introduced at least in some regions into an intermediate space between the muffle 3 and the housing 2. The cooking appliance 1 also has a door 10. The cooking chamber 4 can be closed off on the front face by the door 10. In particular, a front loading opening 11 of the cooking chamber 4 can be closed off thereby.

The cooking appliance 1 also has a hot air system 12. The hot air system 12 is provided as intended to generate hot air which is introduced into the cooking chamber 4. In the exemplary embodiment provided here, the hot air system 12 is arranged in the upper region of the cooking chamber region 4. The hot air system 12 has a front wall 13. This front wall is a separate component from the muffle 3, in particular from the rear wall 7. The front wall 13 is arranged in the depth direction (z-direction) of the cooking appliance 1 in front of the rear wall 7 in the cooking chamber 4. A receiving space 14 is defined by the rear wall 7 and the front wall 13. A heating element 15 of the hot air system 13 and a fan 16 of the hot air system 13 can be arranged in this receiving space 14, for example. The heat generated by the heating element 15 or the air heated thereby in the receiving space 14 is introduced by the fan 16 into the cooking chamber 4 through air passage openings 17 in the front wall 13.

In one exemplary embodiment, this front wall 13 has a front plate 18. Moreover, a front wall shroud 19 is formed adjoining this front plate 18 over the periphery on the edge side. As a result, in this exemplary embodiment the front wall 13 has a trough shape. As a result, the receiving space 14 is also closed or substantially closed by this front wall shroud 19 at the spacing between the front plate 18 and the rear wall 7 measured in the depth direction.

In one exemplary embodiment, it can be provided that at least one further air passage opening 20 is configured on a lower portion of the front wall shroud 19, when viewed in the height direction (y-direction).

Moreover, the cooking appliance 1 has a cooking chamber divider 21. The cooking chamber divider 21 is considered as a separate component. The cooking chamber divider 21 here is a plate-shaped partition plate. The cooking chamber divider 21 is preferably configured entirely without interruption. The cooking chamber divider can be introduced into the cooking chamber 4 at a specific and defined insertion level, when viewed in the height direction. The cooking chamber divider 21 is provided as intended to separate the entire common interconnected cooking chamber 4 into an upper cooking chamber region 4*a* and into a lower cooking chamber region 4*b*. These cooking chamber regions 4*a* and 4*b* are thus in each case sub-regions of the entire cooking chamber 4. These cooking chamber regions are dimensioned such that food to be cooked can be introduced into each of the cooking chamber regions 4*a* and 4*b* for the preparation of the food as intended. The cooking chamber divider 21 is dimensioned in the width direction (x-direction) as shown in FIG. 2, in particular substantially over the entire clear width between the vertical side walls 8 and 9. The cooking chamber divider 21 is dimensioned in the depth direction, in particular substantially over the entire depth, in particular between the rear wall 7 and the loading opening 11. As can be identified, in the exemplary embodiment the hot air system 13 is positioned in the upper region such that, when the cooking chamber divider 21 is removed, the hot air system can be used for the entire cooking chamber 4. When the cooking chamber divider 21 is introduced, and the cooking chamber divider is then arranged in particular in its inserted end position in the cooking chamber 4, the hot air system 12 is provided only for the upper cooking chamber region 4*a*.

Figure 3:
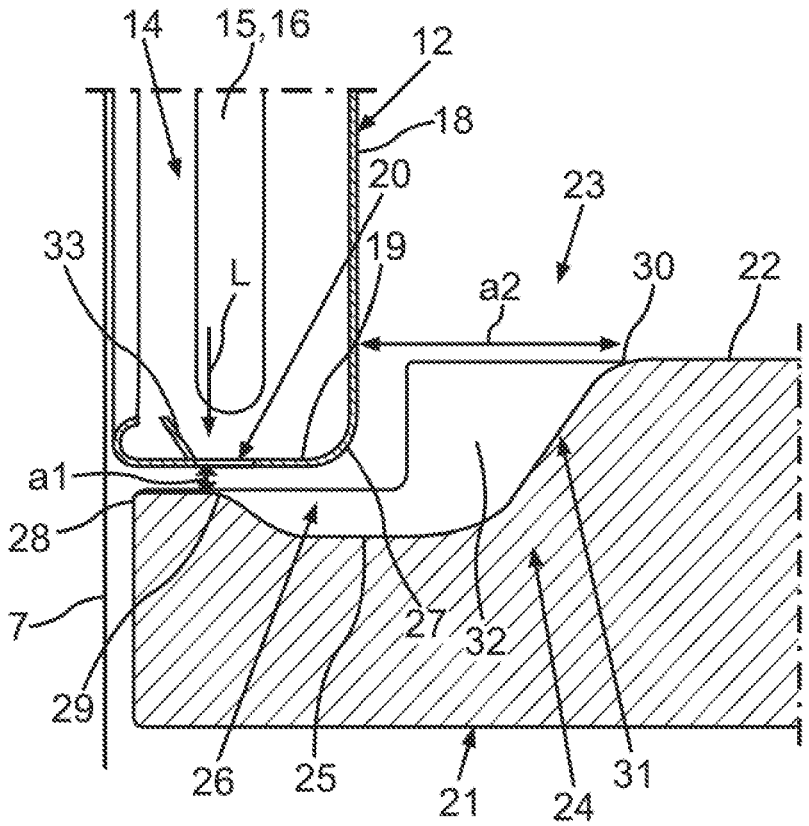
FIG. 3 shows an enlarged view of a sub-region of the cooking appliance according to FIG. 1 and FIG. 2.

As can be identified in FIG. 3, in its end position the cooking chamber divider 21 is arranged immediately adjacent to the front wall 12.

In its end position, the cooking chamber divider 21 is arranged so as to overlap with the front wall 12, in particular the front wall shroud 19, when viewed in the depth direction of the cooking appliance 1. In one exemplary embodiment, in its end position the cooking chamber divider 21 is arranged so as to overlap with this front wall 12, in particular the front plate 18, when viewed in the height direction of the cooking appliance 1. On the side 22 of the cooking chamber divider 21 facing the front wall 12 in an edge region 23 of the cooking chamber divider 21 adjacent to the front wall 12, an uneven flow conducting structure 24 is formed. The flow conducting structure is configured, in particular, so as to be integrated in the cooking chamber divider 21, in particular is produced integrally therewith.

In particular, the uneven flow conducting structure 24 is formed with a defining wall without corners in cross section. In the width direction, the flow conducting structure 24, in particular, is configured over the length in which the air passage openings 20 are arranged. The flow conducting structure 24 and the air passage openings 20 are thus arranged so as to overlap in the width direction. At the opposing ends of the cooking chamber divider 21 in the width direction, the flow conducting structure 24, in particular a depression 25, can be closed toward the sides.

This uneven flow conducting structure 24 is provided as intended to deflect the incoming hot air through air passage openings, in this case in particular the air passage opening 20, into the cooking chamber 4, in this case the cooking chamber region 4*a*, and to deflect the hot air flowing against the cooking chamber divider 21 into the cooking chamber 3, in this case in particular into the cooking chamber region 4*a* assigned to the hot air system 13.

As can be already identified in FIG. 1, the flow conducting structure 24 in the edge region 23 is formed at least in some regions, in particular, as a groove-like depression 25 in this side 22 facing the front wall 12. An enlarged air inflow space 26 is formed between the front wall 12, in particular the front wall shroud 19 facing the cooking chamber divider 21, and this edge region 23.

In one exemplary embodiment, when viewed in the depth direction, this depression 25 is arranged so as to overlap with the front wall 12, in particular the front wall shroud 19. In one exemplary embodiment, when viewed in the height direction, this depression 25 is arranged so as to overlap with the front wall 12, in particular the front plate 18. As can also be identified in FIG. 1, in one exemplary embodiment this depression 25 is formed around a lower edge region 27 of the front wall 12. In particular, the depression 25 is configured to run around a lower corner region which is formed between this lower portion of the front wall shroud 19 and the front plate 18.

In one exemplary embodiment, a rear end 28 of the cooking chamber divider 21 is arranged so as to bear against the rear wall 7 or to be minimally spaced apart therefrom. Moreover, in one exemplary embodiment, it is provided that a rear depression upper edge 29 (FIG. 3), when viewed in the depth direction, is configured to be offset to the front relative to this rear end 28 of the cooking chamber divider 21, when viewed in the depth direction.

Moreover, the front depression upper edge 30 of the depression 25, when viewed in the depth direction, is arranged higher, when viewed in the height direction, than a rear depression upper edge 29 of the depression 25 when viewed in the depth direction.

Moreover, it can also be identified that a front depression region 31 of the depression 25, when viewed in the depth direction, is formed in particular as a continuously upwardly oriented flow ramp as far as the front depression upper edge 30 of the depression 25.

As can be identified in FIG. 1 and in the enlarged view of the partial detail of the interface between the front wall 12 and the edge region 23 in FIG. 3, in the end position in the depth direction the cooking chamber divider 21 is arranged so as to overlap by at least 50%, in particular by at least 80%, with the front wall shroud 19.

A rear depression upper edge 29 of the depression 25, when viewed in the depth direction, is at a first spacing a1 from the front wall shroud 20, when viewed in the height direction. A front depression upper edge 30 of the depression 25, when viewed in the depth direction, is at a second spacing a2 from the front plate 18, when viewed in the depth direction. In particular, the first spacing a1 is smaller than the second spacing a2. This spacing a1 is preferably minimally dimensioned such that hot air L (FIG. 3) which flows out from the receiving space 14 downwardly through the at least one air passage opening 20, is not able or substantially not able to be forced to the rear toward the rear end 28 and past the rear end 28 downwardly into the further cooking chamber region 4*b* in an undesired manner.

As can also be identified in FIG. 3, this rear depression upper edge 29, when viewed in the depth direction, is positioned offset toward the front relative to this rear end 28. As a result, a sub-region of the cooking chamber divider 21 which in the end position of the cooking chamber divider 21 is arranged immediately adjacent to the front wall shroud 19, is provided at this rear end 28. In one exemplary embodiment, when viewed in the depth direction, this rear depression upper edge 29 is arranged so as to overlap with the clear width of the air passage opening 20. In particular, it can be provided that this rear depression upper edge 29 is arranged to be at the same or substantially the same depth position at which a rear end or a rear defining wall of the air passage opening 20 is arranged. Thus, when viewed in the depth direction, the air passage opening 20 is arranged so as to overlap entirely or substantially entirely with the depression 25. This depression 25 extends in the depth direction between the two aforementioned depression upper edges 29 and 30.

As can also be identified in FIG. 3, the depression 25 widens to the front in its spacing from the front wall 12, when viewed in the depth direction. A particularly advantageous flow behavior of the hot air L is made possible specifically around the lower edge region 27 or the corner region of this preferably trough-shaped front wall 12. In one exemplary embodiment, when viewed in the width direction, the depression 25 is defined on the opposing end sides of the cooking chamber divider 21. Thus a depression 25 which is closed on the edge side is formed here in the width direction. A lateral defining wall 32 can be identified in FIG. 3 by way of example here.

In FIG. 3 in one exemplary embodiment it can also be identified that an inclined wall 33 is present. This inclined wall 33 extends into the receiving space 14 and terminates directly at the hole region of the air passage opening 20. This inclined wall 33 is oriented such that hot air L in the receiving space 14 escapes from the receiving space 14 in a direction of flow which is positioned obliquely relative to the vertical hole axis of the air passage opening 20. A direction of flow of the hot air L is predetermined by this inclined wall 33 which is inclined to the rear and upwardly, therefore, so that this hot air L enters obliquely downwardly and to the front into the depression 25 and thus enters obliquely to the front and downwardly into the cooking chamber region 4*a*. The hot air L is also prevented thereby in an improved manner from being able to flow rearwardly toward the rear end 28. Moreover, by this direction of flow and in combination with the defining wall of the depression 25, which is shaped in a concave manner, the hot air is forwarded in a very uniform manner in the depression 25 toward the depression region 31 which serves as a flow ramp. Particularly advantageously, the further conductance of the hot air L into the remaining cooking chamber region 4*a* is also made possible via this flow ramp.

As can also be identified in FIG. 3, the defining wall of the depression 25 is shaped in a U-shaped manner. The defining wall extends in cross section between the rear depression upper edge 29 and the front depression upper edge 30. In the region of the defining wall overlapping with the air passage opening 20 the depression 25 is curved in a concave manner downwardly away from the air passage opening 20. As a result, an advantageous inflow of air L into the depression 25 can take place. When viewed in the positive depth direction toward the front, in one exemplary embodiment the defining wall of the depression 25 only rises upwardly again in a curved concave manner downstream of the front plate 18.

In FIG. 2 the cooking appliance 1 is shown in a front view. The width of the cooking chamber divider 21 can be identified herein.

Figure 4:
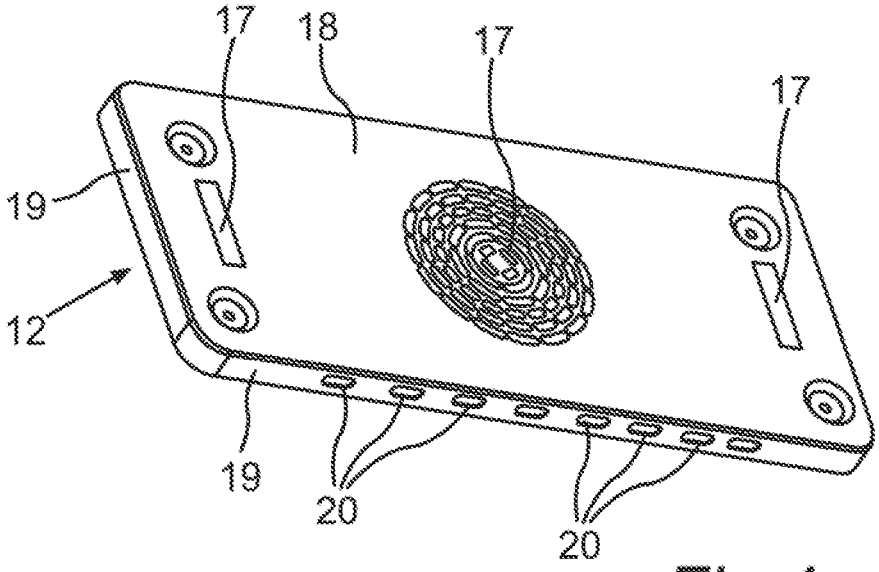
FIG. 4 shows a perspective view of an exemplary embodiment of a front wall of a hot air system of the cooking appliance.

In FIG. 4 the exemplary embodiment of the front plate 12 is shown in a perspective view, as is preferably present in the cooking appliance 1. The trough shape can be correspondingly identified here. A plurality of air passage openings 20 on the front wall shroud 19 are also shown here.

The invention claimed is:

1. A cooking appliance, comprising:

a housing;

a muffle arranged in the housing and having walls to define a cooking chamber;

a hot air system having a front wall which is arranged in the cooking chamber such as to form a receiving space for components of the hot air system between a rear one of the walls of the muffle and the front wall of the hot air system, said front wall having air passage openings through which hot air is conductable from the receiving space into the cooking chamber; and a plate-like cooking chamber divider removable from the cooking chamber and configured to separate the cooking chamber into a first cooking chamber region and into a second cooking chamber region when assuming an end position in which the cooking chamber divider overlaps with the front wall of the hot air system, when viewed in a depth direction of the cooking appliance and/or in a height direction of the cooking appliance, said cooking chamber divider having in facing relation to the front wall a side which has an edge region adjacent to the front wall and formed with an uneven flow conducting structure to deflect hot air, entering the cooking chamber through the air passage openings and flowing against the cooking chamber divider, into the first cooking chamber region for supply with hot air, wherein the flow conducting structure comprises a groove.

2. The cooking appliance of claim 1, wherein the flow conducting structure at least in one region of the edge region is formed in the side of the cooking chamber divider such as to form an enlarged air inflow space between the front wall of the hot air system and the side of the cooking chamber divider.

3. The cooking appliance of claim 1, wherein the cooking chamber divider encompasses an entire width of the cooking chamber between two vertical side walls of the muffle and/or an entire depth as far as a front loading opening of the cooking chamber and is formed as an uninterrupted plate, so that a partition plate is formed.

4. The cooking appliance of claim 1, wherein, when viewed in the depth direction, the groove is configured so as to overlap with the front wall of the hot air system.

5. The cooking appliance of claim 2, wherein, when viewed in the depth direction, the groove is configured so as to overlap with the front wall of the hot air system.

6. The cooking appliance of claim 2, wherein, when viewed in the height direction, the groove is configured so as to overlap with the front wall of the hot air system.

7. The cooking appliance of claim 2, wherein the groove is formed around a lower edge region of the front wall of the hot air system.

8. The cooking appliance of claim 2, wherein, when viewed in the depth direction, the groove has a rear depression upper edge which is arranged offset to a front relative to a rear end of the cooking chamber divider.

9. The cooking appliance of claim 2, wherein, when viewed in the depth direction, the groove has a front depression upper edge which is located higher, when viewed in the height direction, than a rear depression upper edge of the depression, when viewed in the depth direction.

10. The cooking appliance of claim 2, wherein, when viewed in the depth direction, the groove has a front depression region which is formed as a flow ramp as far as a front depression upper edge of the groove.

11. A cooking appliance, comprising:

a housing;

a muffle arranged in the housing and having walls to define a cooking chamber;

a hot air system having a front wall which is arranged in the cooking chamber such as to form a receiving space for components of the hot air system between a rear one of the walls of the muffle and the front wall of the hot air system, said front wall having air passage openings through which hot air is conductable from the receiving space into the cooking chamber; and a plate-like cooking chamber divider removable from the cooking chamber and configured to separate the cooking chamber into a first cooking chamber region and into a second cooking chamber region when assuming an end position in which the cooking chamber divider overlaps with the front wall of the hot air system, when viewed in a depth direction of the cooking appliance and/or in a height direction of the cooking appliance, said cooking chamber divider having in facing relation to the front wall a side which has an edge region adjacent to the front wall and formed with an uneven flow conducting structure to deflect hot air, entering the cooking chamber through the air passage openings and flowing against the cooking chamber divider, into the first cooking chamber region for supply with hot air, wherein the front wall of the hot air system is formed in a trough-shaped manner with a front plate and a front wall shroud which is arranged over a periphery on an edge of the front plate.

12. The cooking appliance of claim 11, wherein the cooking chamber divider is arranged in the end position in the depth direction so as to overlap by at least 50% with the front wall shroud.

13. The cooking appliance of claim 11, wherein the cooking chamber divider is arranged in the end position in the depth direction so as to overlap by at least 80% with the front wall shroud.

14. The cooking appliance of claim 11, wherein, when viewed in the depth direction, the groove has a rear depression upper edge which is at a first spacing, when viewed in the height direction, from the front wall shroud, and a front depression upper edge which, when viewed in the depth direction, is at a second spacing, when viewed in the depth direction, from the front plate, wherein the first spacing is smaller than the second spacing.

15. The cooking appliance of claim 11, wherein the front wall shroud includes at least one of the air passage openings.

16. The cooking appliance of claim 15, wherein the at least one of the air passage openings is formed in a side-facing portion of the front wall shroud.

17. The cooking appliance of claim 15, wherein the groove and the at least one of the air passage openings are arranged so as to overlap with one another at least in one region in the front wall shroud, in the depth direction.

18. The cooking appliance of claim 15, wherein the at least one of the air passage opening in the front wall shroud has an inclined wall which protrudes from the front wall shroud obliquely to a rear into the receiving space such that for the hot air in the receiving space an oblique direction of flow to a hole axis of the at least one of the air passage openings is predetermined by the inclined wall, such that the hot air flows obliquely into the groove when passing through the at least one of the air passage openings while facing the cooking chamber and facing away from the rear wall of the muffle.

* * * * *